US012011646B2

(12) United States Patent
Wells

(10) Patent No.: US 12,011,646 B2
(45) Date of Patent: Jun. 18, 2024

(54) MULTI-DIRECTIONAL EXPANDABLE MODULAR EXERCISE LADDER

(71) Applicant: John Andrew Wells, Phoenix, AZ (US)

(72) Inventor: John Andrew Wells, Phoenix, AZ (US)

( * ) Notice: Subject to any disclaimer, the term of this patent is extended or adjusted under 35 U.S.C. 154(b) by 139 days.

(21) Appl. No.: 17/803,060

(22) Filed: Jan. 31, 2022

(65) Prior Publication Data

US 2023/0241474 A1 Aug. 3, 2023

(51) Int. Cl.

| | |
|---|---|
| ***A63B 69/00*** | (2006.01) |
| *A63B 102/02* | (2015.01) |
| *A63B 102/22* | (2015.01) |

(52) U.S. Cl.

CPC ..... *A63B 69/0028* (2013.01); *A63B 2102/02* (2015.10); *A63B 2102/22* (2015.10); *A63B 2209/10* (2013.01); *A63B 2210/50* (2013.01); *A63B 2243/0025* (2013.01); *A63B 2243/0037* (2013.01); *A63B 2243/007* (2013.01)

(58) Field of Classification Search

CPC ..... A63B 69/0028; A63B 2102/02; A63B 2102/22; A63B 2209/10; A63B 2210/50; A63B 2243/0025; A63B 2243/0037; A63B 2243/007

USPC ..... 473/422

See application file for complete search history.

(56) References Cited

U.S. PATENT DOCUMENTS

| | | | | |
|---|---|---|---|---|
| 320,114 | A * | 6/1885 | Bormann | |
| 3,255,115 | A * | 6/1966 | Peterson | A63B 69/0028 482/148 |
| 4,176,471 | A * | 12/1979 | Roe | A61H 3/00 434/255 |
| 5,114,203 | A | 5/1992 | Carnes | |
| 7,874,959 | B2 * | 1/2011 | Dieter | A63B 69/0028 482/14 |
| 9,393,461 | B1 * | 7/2016 | Villagra | A63B 5/22 |
| 9,675,830 | B2 * | 6/2017 | Holland | A63B 69/00 |
| 2015/0099609 | A1 * | 4/2015 | White | A63B 71/03 482/23 |
| 2017/0246523 | A1 * | 8/2017 | Holland | E06C 1/52 |

* cited by examiner

*Primary Examiner* — Nini F Legesse

(57) ABSTRACT

A multi-directional expandable modular agility exercise ladder has spaced rows of two part paired rungs having overlapping ends joined to each by a pivot post forming a variable angle chevron prow. Outer ends of the paired rungs are interlocked to two parallel spaced bands to complete the ladder. A hook and loop pad interlock is used. Alternately, spaced key holes extend through the bands with the outer ends of the rungs having downwardly extending retainer poles secured in a respective key hole. Alternately, releasable spring clamps hand movable along the band length secure rung ends to the bands.

2 Claims, 10 Drawing Sheets

MULTI-DIRECTIONAL EXPANDABLE MODULAR EXERCISE LADDER

FIELD OF THE INVENTION

The present invention relates to improved foot agility exercise ladders commonly used in sports for foot agility, training and conditioning drills such as American football, soccer, basketball, field hockey, rugby, tennis and a host of other track sports requiring foot coordination and timing. The ladder configurations are easily changed to aid the athlete in improving cadence and rapid and accurate foot placement by varying the foot space area and shape between rungs of the ladder. The ladder's flexible configurations present new challenges requiring rapid development of proper overall body posture, quickened reflexes, and heightened stamina and confidence while avoiding over training caused by the repetitive nature of set drills.

BACKGROUND OF THE INVENTION

Modern sports agility exercise training ladders basically consist of plastic rungs spaced along parallel flat bands with the rung ends connected to the bands. This allows the bands and rungs to be easily unwound from storage and rewound at the end of the drills. The most advanced ladders even provide for selectively placement of the rung ends along the band length. An example is the Essential 3.20 m (meters) Football Agility Ladder. Each top surface of the band has an uninterrupted top Velcro® surface. The underside ends of each rung have a single Velcro complementary Velcro pad completing the Velcro interlock of rung and band. Each rung is one v-shaped piece and forms a fixed shallow prow angle with the rungs forming a uniform chevron v pattern formation. Both the hook and loop portions of the two part Velcro interlock are prone to cleaning problems. The rewinding of the ladder after use is prone to snagging of the Velcro creating tangles requiring time consuming effort to untangle. This is caused primarily by the uninterrupted surface area length of the Velcro pattern on the bands presenting an unnecessarily large Velcro surface area prone to snagging. The fixed prow angle of the v-shaped rung also prevents widening of the area between bands making it necessary to have on hand an inventory of utility ladders with multiple sizes of longer v-rungs for the foot drills of bigger athletes. For safety reasons, when a rung is damaged, the entire prior art rung has to be replaced as contrasted with the two rung pair of the present invention when only one of the rungs of the rung pair is damaged.

It is the purpose of this invention to provide an improved rung pair joined by a controllable pivot position for each rung pair. It is another purpose of the present invention to improve on the known agility ladder Velcro designs to reduce time/space spent to deploy and store the rungs.

BRIEF SUMMARY OF THE INVENTION

The present invention is directed to a durable plastic two-part rung capable of being reshaped from a straight rung shape into a "V" shape by connecting the two-part rung by a center pivot to form a rung pair. The ends of the two-part rung are secured in an easily and quickly detachable manner to spaced parallel side bands with the distance along and between the bands being changeable. The bands are made of nylon or other plastic materials suitable for winding which facilitates storage/transportation. When assembled and deployed, the rung pairs and bands form an agility ladder with the rung pairs having a chevron pattern of equally spaced V rungs or a straight rung ladder. The center pivot leads as the prow of the rung pair forming a chevron rung pattern of roughly 40° to 135° with wider range possible. The center pivot allows variation in drills by changing the angle of the rungs useful in moving from warm-up footwork drills using straight parallel rungs to increasingly harder chevron aligned rung patterns in timed drills. Greater attention and focus on the foot space area is easily changed to more difficult foot space patterns requiring greater skill coordination of overall body posture, quickness, rhythm, cadence and balance.

This invention uses as a visual cue a centerline effect of the aligned prows of the chevron patterned rungs. This cue reinforces at a glance the location of spaces within the ladder which the athlete's feet must navigate. The two-part rungs connected at their inner ends by a pivot post permits variable angled V chevron patterns as a subgroup of the overall longer rung pattern of the ladder, i.e. several rungs may be grouped at 60° and several other rungs grouped at 90°. Such variation challenges the athlete to adjust foot stride, rhyme and cadence during the same drill.

In one embodiment multiple spaced retaining poles mounted on the underside of a rung act as retainer poles when engaged in a keyhole of a band. A row of such retainer poles allows the bands to be spaced closer or further apart. In addition, asymmetrical rung pairs allow a larger foot space on one side of the longer rung of a pair than on the attached shorter side of the other rung. The retainer poles interlock with keyholes cut in the parallel bands. The pivot post for the rung pair is no longer centered symmetrically between the side bands.

DETAILED DESCRIPTION OF THE INVENTION

Figure 1:
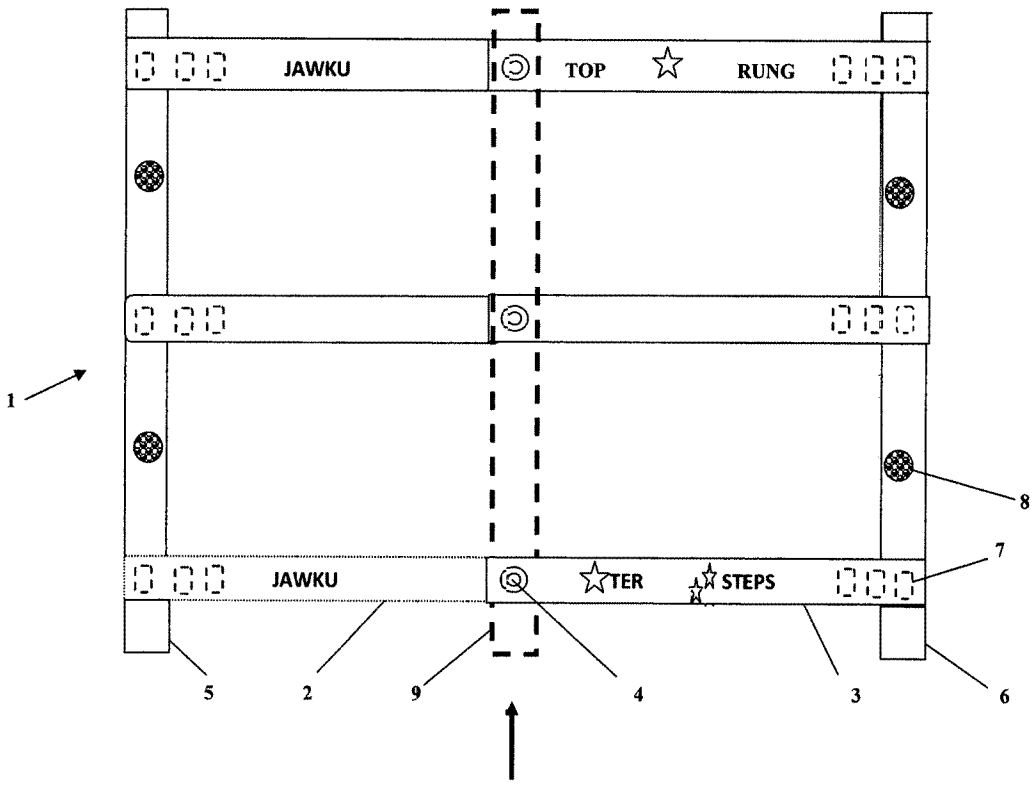
FIG. 1 is a plan view of an agility ladder pattern with each pair of rungs attached to each other by a center pivot post with the pairs of rungs forming a fully extended straight rung.

A first embodiment of the agility ladder 1 of this invention is shown in FIG. 1. The agility ladder is a product marketed by JAWKU L.L.C., a Delaware Corporation, whose name is shown at the bottom pair of rungs along with the slogan "STARTER STEPS" and the finishing top rung pair along with the motivating slogan "TOP STAR RUNG" with the graphic symbol of a star used in place of the word lettering "star" in both slogans. The top pair of rungs may be awarded as a prized memento to the best athlete scoring the most points at the end of the day's drills.

The ladder's main components are pairs of rungs 2, 3 connected by a pivot post 4. The outer ends of each connected pair are in turn spaced from each other and detachably fastened to corresponding parallel side bands 5, 6 which on the ground form the framework of the agility ladder. A preferred interface on the band is the Velcro® strip, sometimes referred to generally as a hook and loop fastener or interlock, having opposing easily separable pieces of fabric, one piece with a dense array of tiny nylon hooks and the other piece having a dense nylon loop pile, that when pressed together form an easily removable interlock. Several nylon hook pads 7 (shown in phantom outline as rectangles) are located in rows distal from the pivot post 4 on the underside of each rung. Nylon pile pads 8 are placed equally spaced in a row on the bands 5, 6. Either or both hook pad 7 and pile pad 8 may have other geometric surface areas, such as rectangles or circles.

Figure 1A:
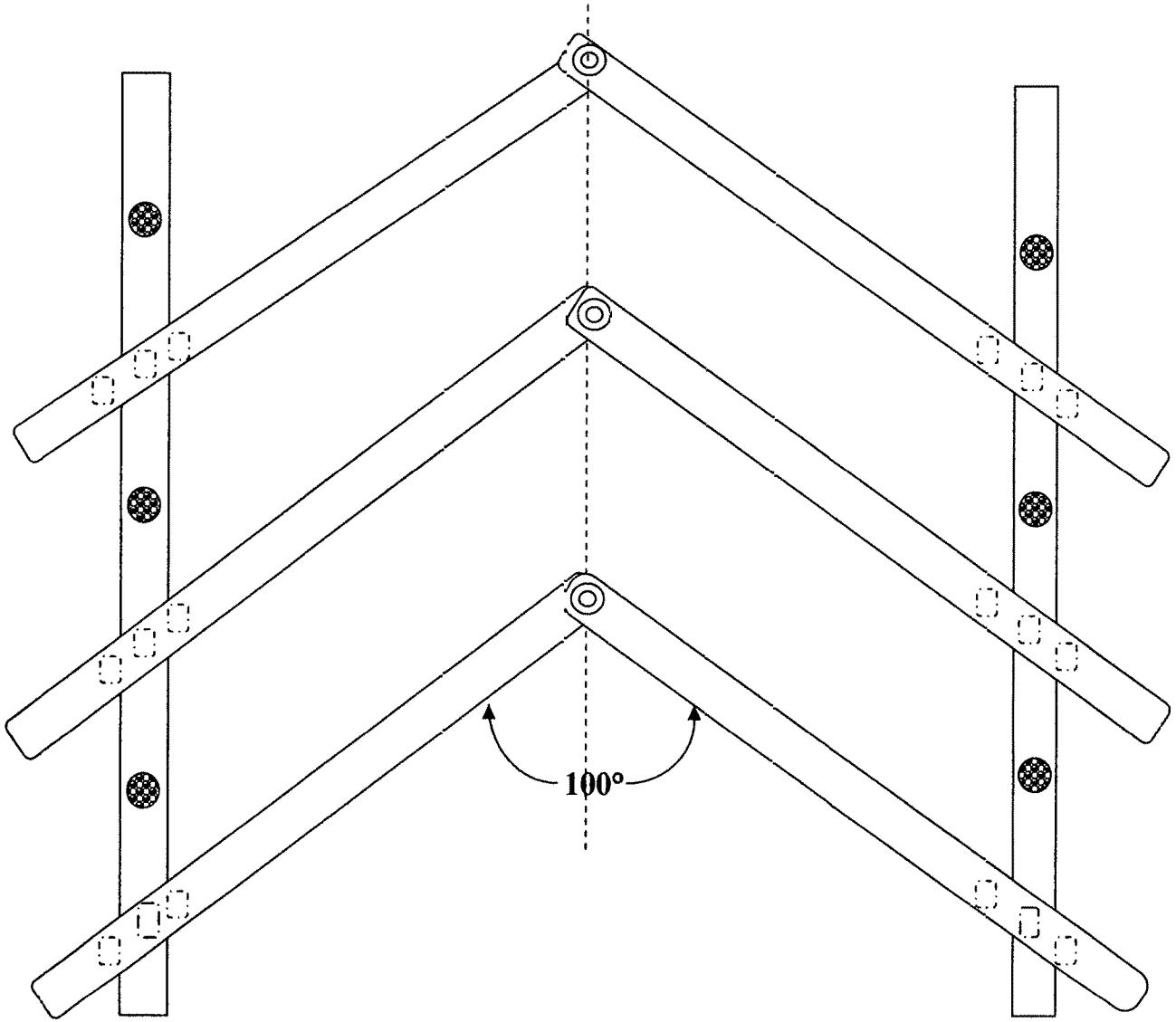
FIG. 1A is a plan view similar to the ladder of FIG. 1 of the rungs having a chevron pattern with the side bands closer together.

Optionally, an intermediate tape 9, located at the centerline between bands, is shown outlined to delineate the course for one foot or both feet hopping drills. The bottoms of the pivot posts 4 pin or press the tape 9 to the ground. The intermediate tape 9 is a visual aid in leg muscle and reflex conditioning to improve the athlete's quickness and overall dexterity when navigating as quickly as possible in confined foot space areas. Tape 9 allows the agility ladder to be modified for a mix of different sized areas permitting drill layouts to differ forcing an adjustment to the cadence rhythm of the athlete running, for example, a sideways drill between the bands. FIG. 1A shows the selection of every other hook pad 7 on each pair of rungs interlocking with every other pile pad 8 along with the relocation of the parallel side bands inwardly from that shown in FIG. 1.

Pivot post 4 combined with the rows of rung pads 7 and rows of band pads 8 allows the size and shape of the foot space between rung pairs to vary as suitable for different agility drills commonly used in training exercises. Many space variations are possible and only a few examples of basic ones are illustrated. The rungs maybe positioned in lines either diagonal to the side bands or at a right angle and either parallel or unparallel.

Pivot post 4 allows a fast change to the angle of the prow of each rung pair over a wide range preferably, but not limited to 40° to 135° with 100° shown in FIG. 1A. Either or both the rung pair angle and the distance between the bands may be adjusted. The rows of pads 7 on the underside of each rung allow the pattern of rung pairs to change from the ladder of FIG. 1 to a chevron pattern shown in FIG. 1A. The distance between bands when moved inwardly or outwardly allows a different pad 7 in a row of rung pads to interlock with one of the band pads 8 forming a new prow angle of chevron shape.

Figure 1B:
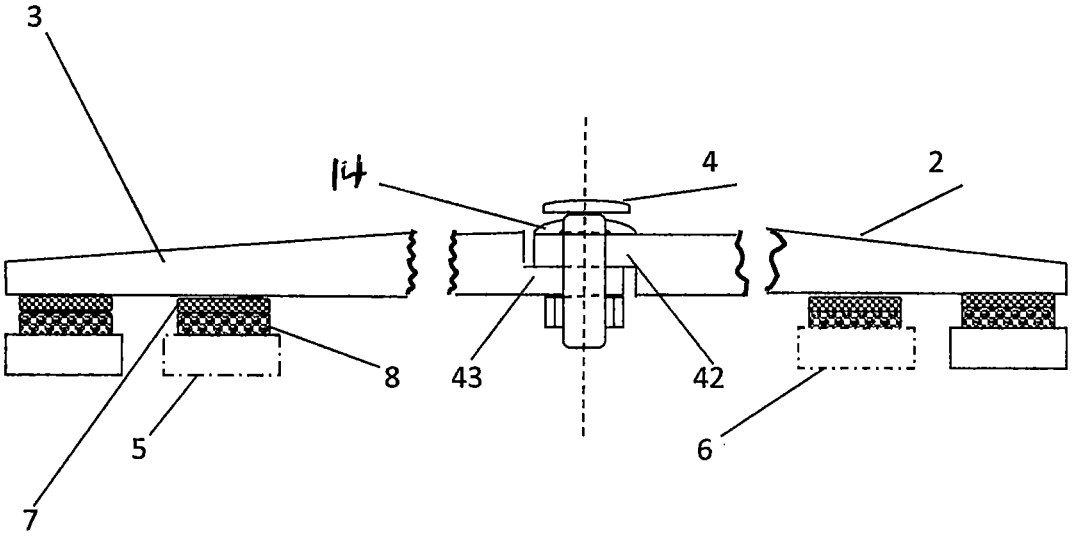
FIG. 1B is a front view at ground level of a rung pair of FIG. 1 held in contact by a Belleville® spring washer.

FIG. 1B show details of the rung pair 2, 3 connected to pivot post 4. Thinner rung ends 42, 43 overlay each other as a safety feature to reduce thickness at their connection point, thereby minimizing a potential tripping hazard. Any spring washer, such as a Belleville® spring cone washer 14, is placed between the underside of the head of the pivot post 4 and a top surface of the rung 2. A tightening nut (shown but unnumbered in FIG. 1B) grips the bottom end of the pivot post 4 and contacts the underside of rung 43 to adjust the tension of the washer 14. The washer 14 provides a spring clutch braking action to allow pivotal rung movement between the rung pair to be easily controlled reducing an unwanted, unfettered movement to different rung positions. This clutch action permits a rapid redeployment of each rung pair relative to the outer bands 5, 6 being moved inward as shown in phantom while still retaining the previous prow angle setting.

Figure 7:
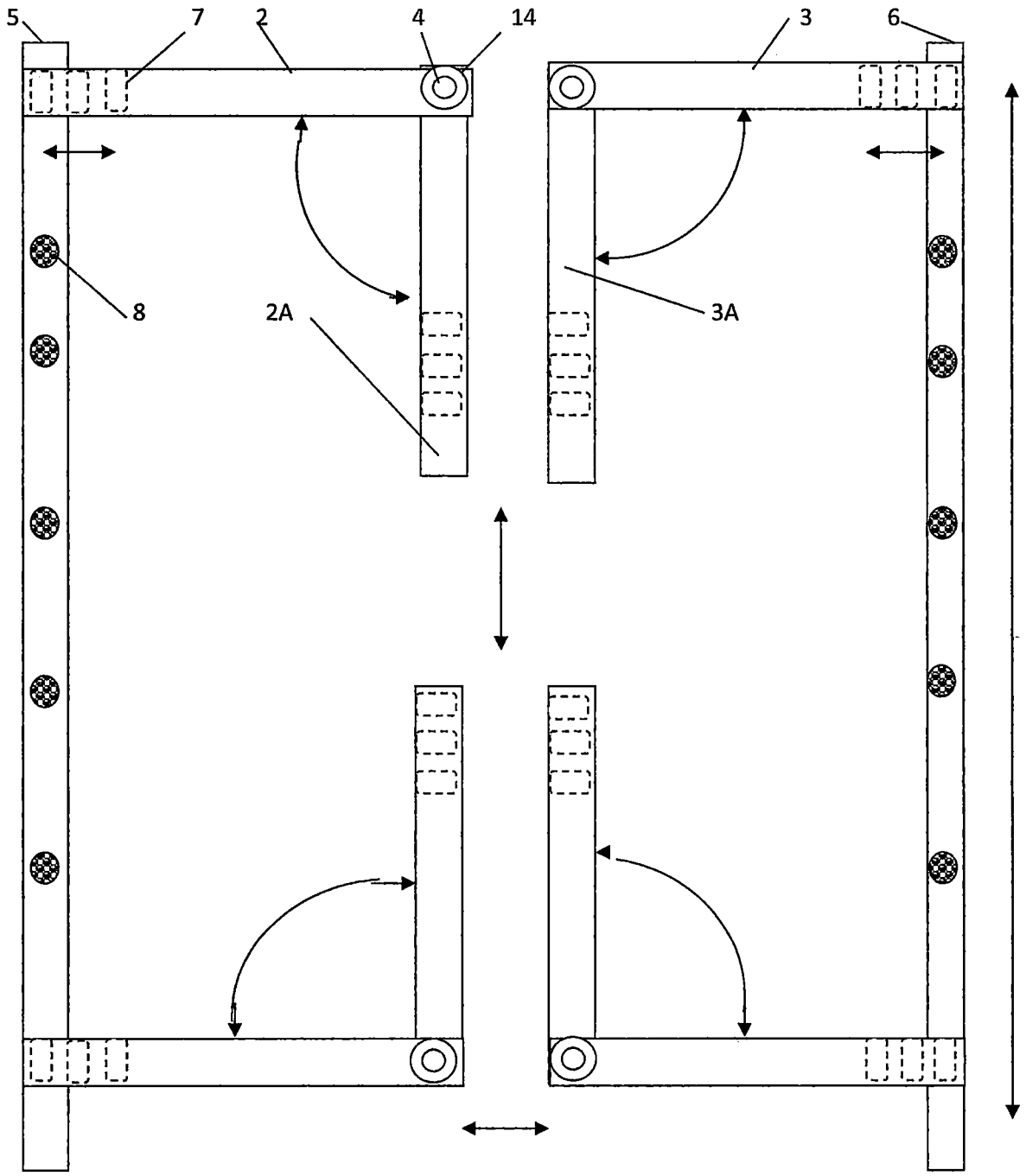
FIG. 7 is a plan view of another alternate ladder embodiment wherein one end of a rung pair is disconnected and free of any connection with a band.

Belleville washer 14 can snugly hold the rungs 2, 3 firmly at desired angles, such as right angles, enabling the different sized rectangular "open" patterns show in FIG. 7. The term "open" herein refers to one end of a rung pair being free, that is, not secured to a second side band creating the open distances shown in FIG. 7. This enables the same width of band material to interlock rung pair ends on either side saving valuable gym floor space or open field space. Some sports strictly limit supervised training time putting maximum time pressure on athletes and coaches. Indoor sports drills using this innovative agility ladder can greatly benefit the most athletes in the assigned gym time.

The agility ladder split nature of the format of the FIG. 7 duo left and right unconnected band pairs permits athletes side by side to simultaneously compete in drills against each other. This competition can act as a powerful incentive to maximize an athlete to greater effort and a not so subtle hint which athlete is ahead for the nod to first string or benched. The flexible format of the duo split ladders provides an advantage in accommodating different sized gym floor spaces as shown by the double arrows of FIG. 7. The addition of rows of interlocking Velcro pads 7 along with close spacing of the complementary Velcro pads 8 on bands 5, 6 provide for this expansion of directions. A desirable stabilization of movement of the free end of rungs 2A and 3A is achieved with the combination of the tightening feature of the Belleville spring cone washer 14 mounted on the pivot post 4.

Figure 2:
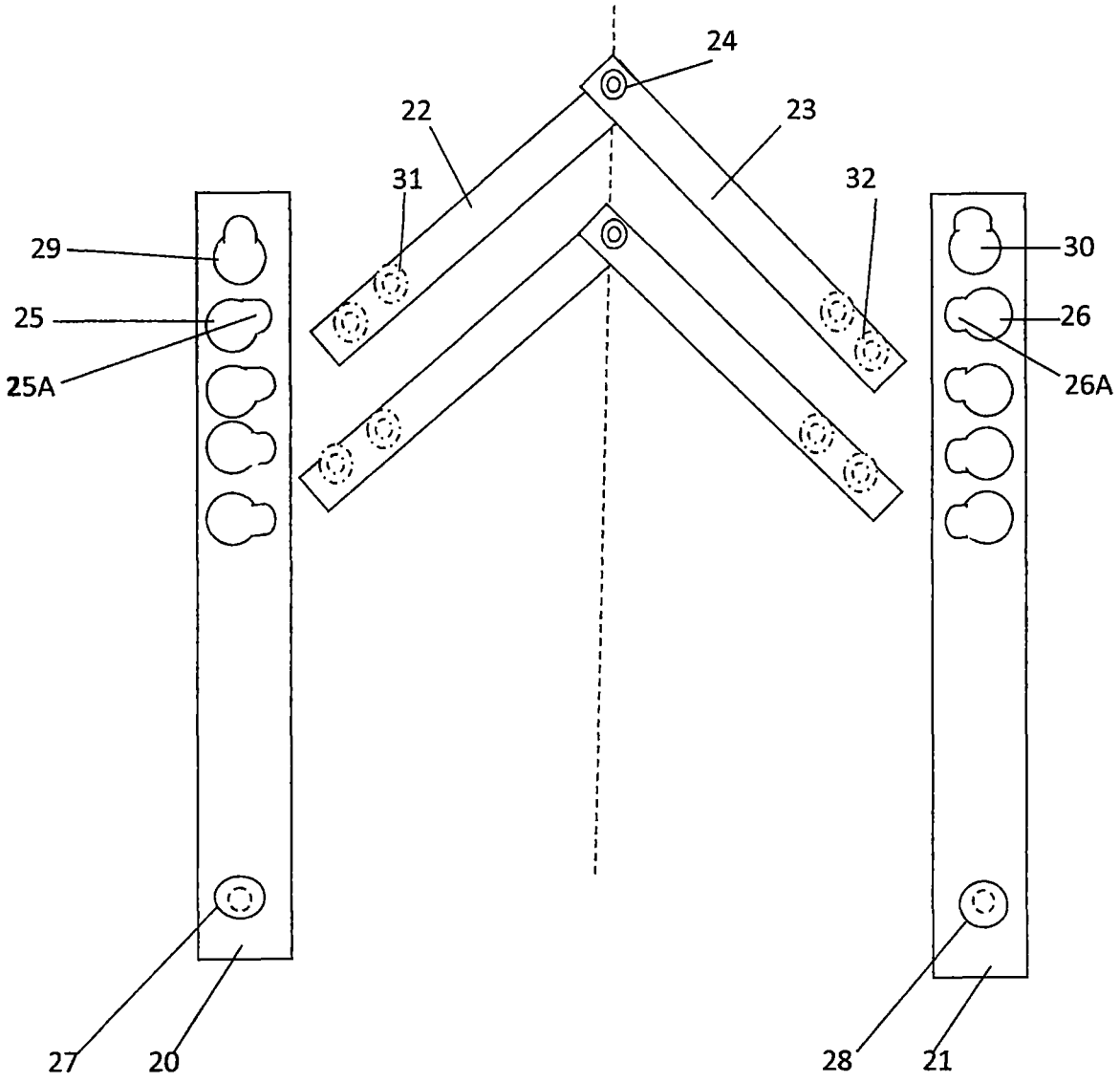
FIG. 2 is an alternative embodiment of a plan view of a ladder, not yet assembled, with a chevron rung pattern showing keyholes through the side bands and complementary retaining poles on the underside of the rungs.

An alternative embodiment of an agility ladder is depicted in the FIG. 2 plan view in unassembled form. The pairs of rungs 22, 23 are in a chevron V pattern. The side bands 20, 21 have keyholes formed of large entrance/exit openings 25, 26 intersected by smaller retaining openings 25A, 26B through the bands.

Figure 2A:
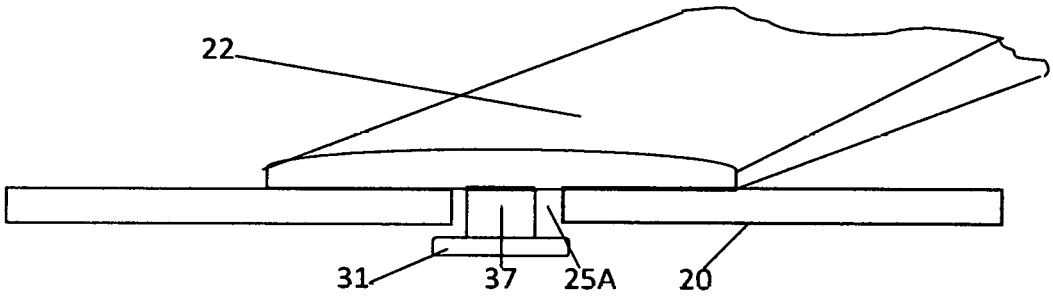
FIG. 2A is a sectional side detail view of the engagement of a retaining pole of a rung and a keyhole of a side band of FIG. 2.

Referring to FIG. 2A, interlocks in the form of discs 31, 32 on the terminal ends of retainer poles 37 (See FIG. 2A)

are fixedly attached at the underside of the rungs 22, 23 and engage the side bands through the keyholes. Retainer poles 37 protrude towards the ground with discs 31, 32 at the distal end of the retainer pole 37. As seen in FIG. 2A, this pins the underside of the side band 20 between the disc 31 and the underside of rung 22.

Keyholes 29, 30 are positioned through the top end of each side band with the smaller keyhole opening portion closest to the end of the length of the band. The bottom end of each side band 20, 21 have attached thereto a retainer pole 27, 28 facing upward to receive the keyholes 29, 30 of consecutive side bands to be joined. This feature permits several side bands to be consecutively linked end to end to form a longer agility ladder.

Figure 2B:
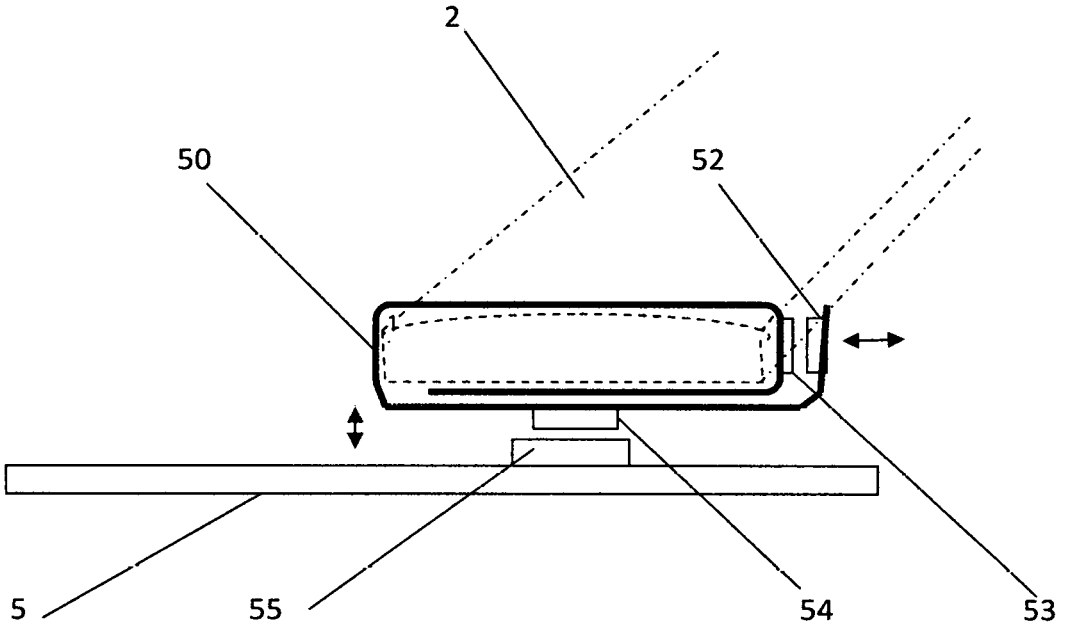
FIG. 2B is a side end view of an alternative embodiment for securing the end of a rung to the underlying side band using Velcro® complementary pads on different sides of a rung belt.
Figure 2C:
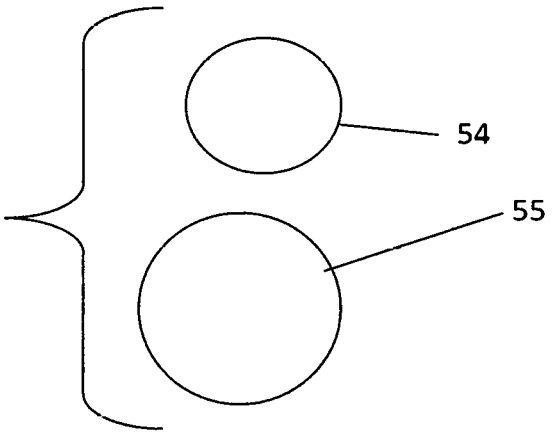
FIG. 2C is a top view of a unattached circular Velcro pad combination used in FIG. 2B with the hook portion having a different diameter than the loop portion.

In another alternative embodiment, shown in FIG. 2B, a belt 50 is wrapped around the end of a rung 2 and is held in place by a single Velcro interlock of pads 52, 53 functioning as a belt buckle. A second Velcro interlock of pads 54, 55 secures the outer surface of strap 50 to the top surface of side band 5. The FIG. 2B embodiment is particularly useful to facilitate rapid redeployment of the belt position along a rung's length unlike the limited fixed positioning of pads 7 described above for the FIG. 1B embodiment. In FIG. 2C, Velcro pad 55 is shown slightly larger in area than pad 54 to allow for a larger target placement area for the smaller pad 54 mounted on the belt.

Figure 3:
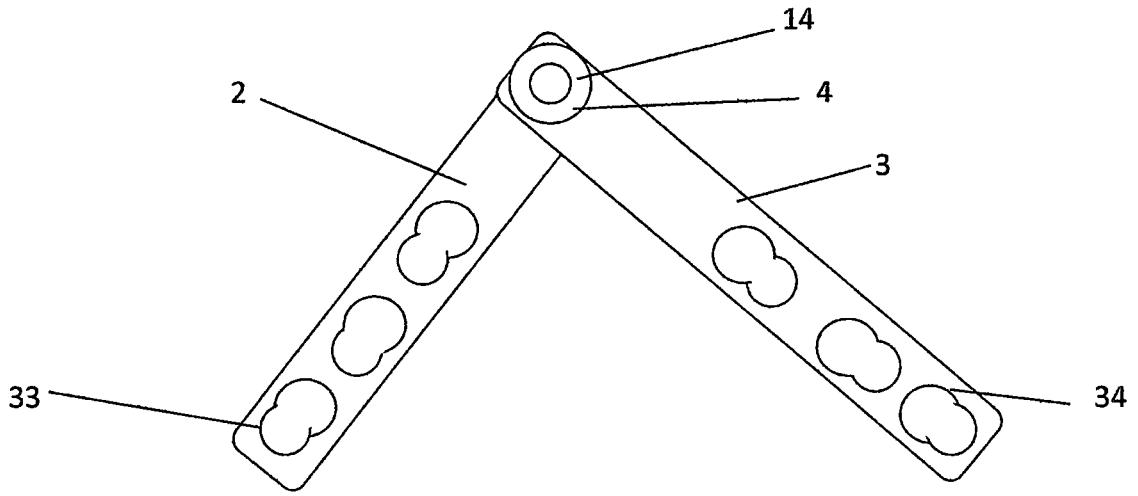
FIGS. 3 and 4 are plan views of the top and bottom of another embodiment with keyholes though the rungs rather than being placed in the side bands shown in FIG. 2.

FIG. 3 depicts, in another embodiment, the utility ladder's rung pairs 2, 3 with rows of keyholes 33, 34 near their ends rather than keyholes in the side bands.

Figure 4:
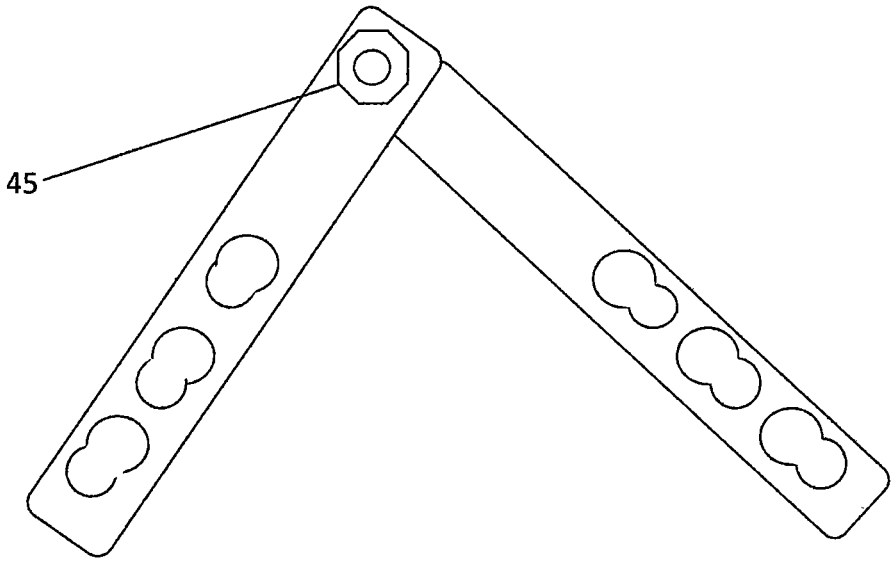
Figure 5:
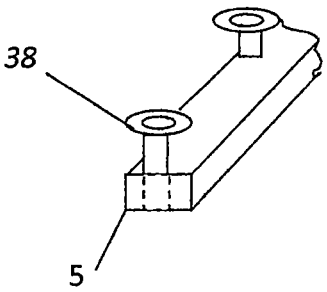
FIG. 5 is a detail view of a retainer pole mounted on a side band for use with the FIG. 3 rungs.

FIG. 4 shows the underside of the rungs of FIG. 3 looking upward showing a retaining nut 45 engaging the bottom of pivot post 4. In this embodiment retainer pole 38, shown in detail in FIG. 5, are affixed to the top surface of the side band in a row. The pole 38 is attached to a disc facing upward to interlock with a selected keyhole on the rung.

Figure 6:
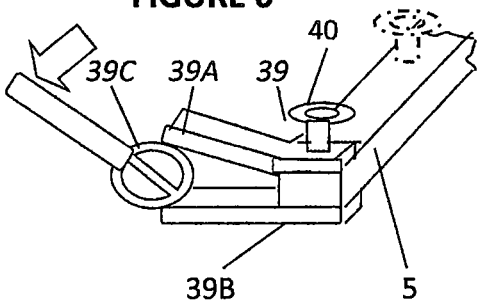
FIG. 6 is a side view of an alternate embodiment retainer pole attached by a spring clamp to a side band for interlocking with the keyholes of the FIG. 3 rungs.

Referring to FIG. 6, in place of a fixed row of retainer poles 38, a retainer pole 39 and retainer disc 40 is mounted on a spring clamp 39C having upper and lower spring clamp arms 39A and 39C. The spring clamp 39C has a lever easily opened or closed by hand/foot pressure on the end of the lever with the side band 5 firmly held there between. This embodiment represents one example of using a movable clamp or clip useful in securing rung end pairs at different customized lengths on the side bands of the agility ladder.

Figure 7A:
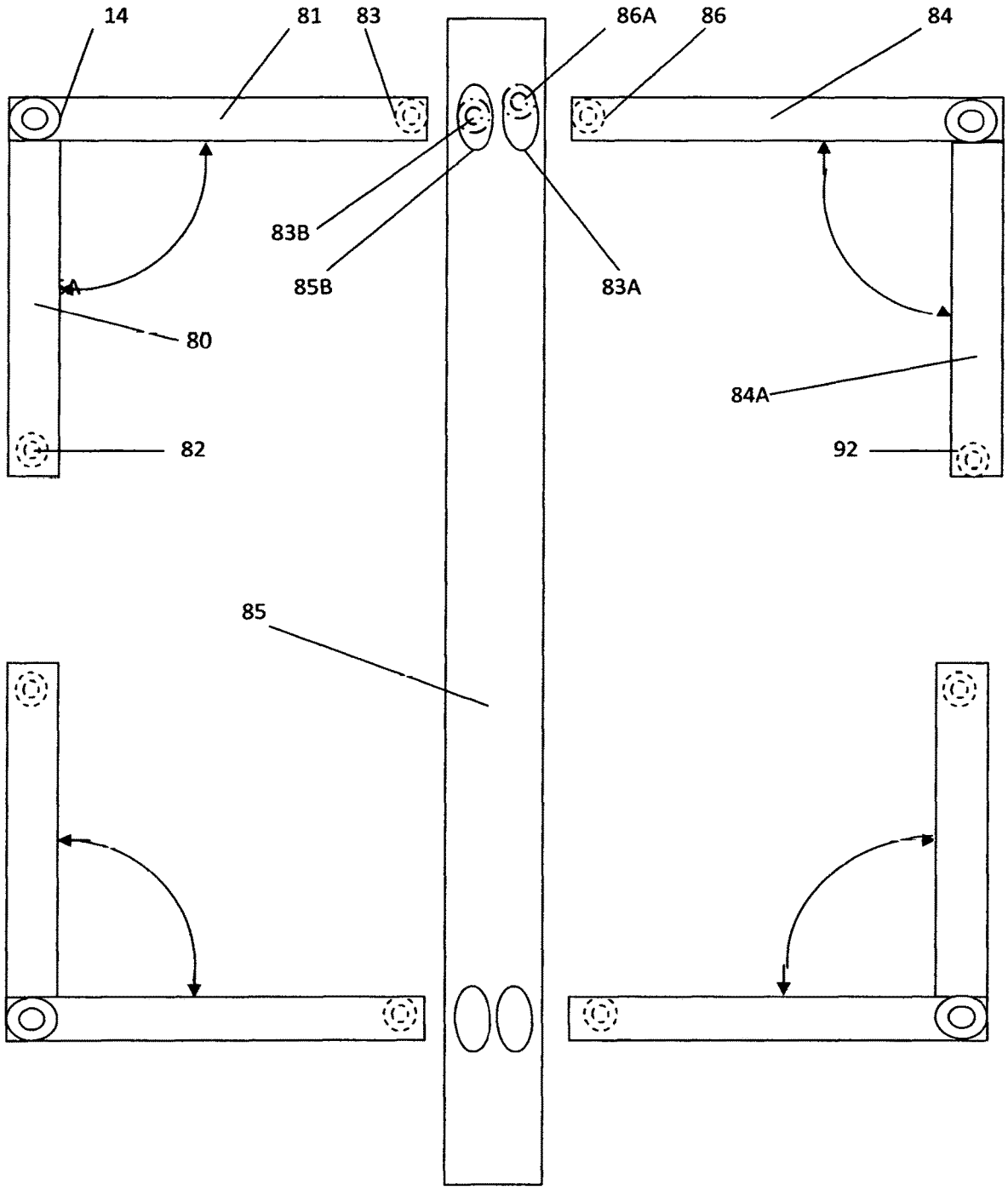
FIG. 7A is a variation of FIG. 7 showing a plan view of a single center band having spaced rows of pairs of adjacent elliptical keyholes for interlocking rung pairs on each side of the center band.

In another embodiment, referring to FIG. 7A, one central side band 85 has oval keyholes 85A, 85B rather than the keyholes 25, 26 previously disclosed in FIG. 2. The oval keyholes are located in pairs to permit connection of rung pairs 80, 81, and 84, 84A from each side of the central side band 85. The underside of rung pair 80, 81 has retainer poles 82, 83 the same as retainer poles 37 of the FIG. 2A embodiment. Similarly, rung pair 84, 84A has retainer poles 86, 92 for engaging the keyholes 85B. The band 85 at the top is shown connected to phantom outlined retainer poles 83A and 86A. For the clarity of FIG. 7A, a phantom retainer pole 83B is shown in the center of the keyhole representing an entrance/exit position for the retainer pole. Phantom pole 86A is shown moved to the top of oval keyhole 83A to affect interlock of the rung 84 of rung pair 84, 84A. Positional mirror symmetry of the rung pairs on either side of the central band is achieved by the retainer poles of a rung being moved to either the top or bottom of the oval keyholes.

Figure 8:
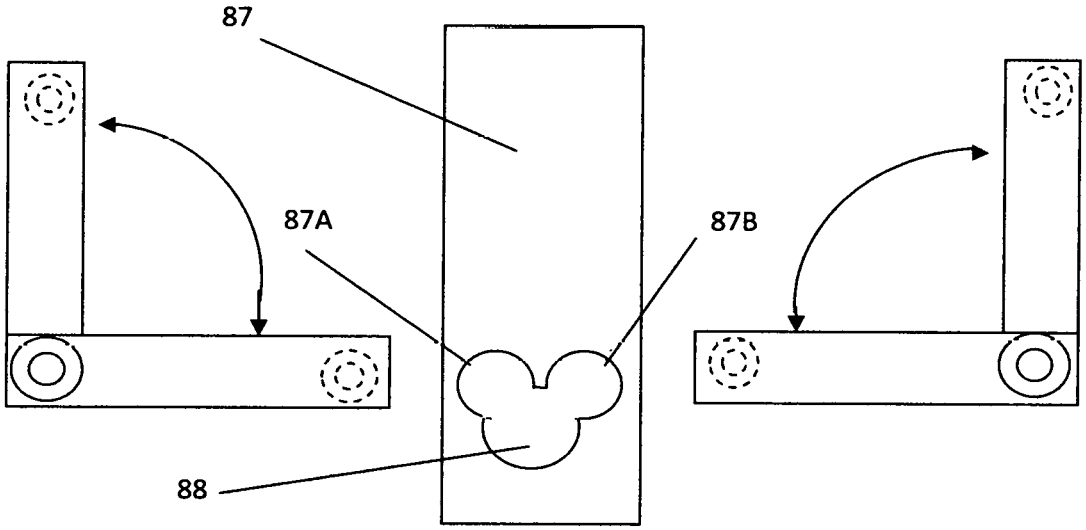
FIG. 8 is a variation of FIG. 7A showing a wider single center band with a single center keyhole intersected by two closely spaced smaller semi-circular keyholes for interlocking rung pairs.

FIG. 8 shows an unassembled layout in another variation. Wide band 87 has a center key hole 88 with the wide band 87 wider than band 85 of FIG. 7A. The wide band 87 has a center key hole 88 with interlocking semi-circular keyholes 87A, 87B placed above the center of key hole 88.

Figure 9:
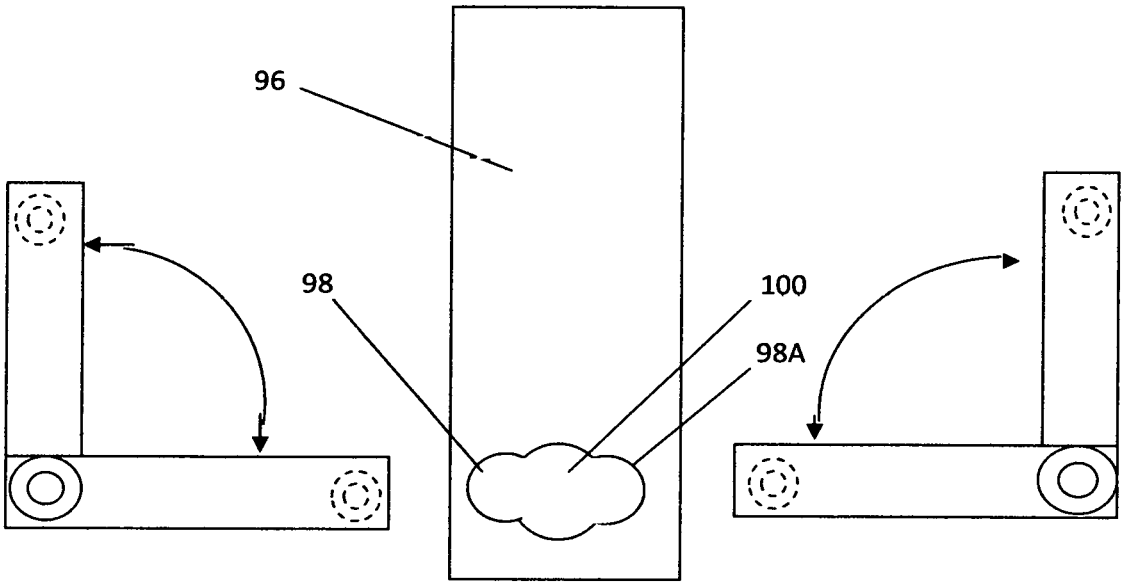
FIG. 9 is a plan view of a variation of FIG. 8 showing a wider single center band with a single center keyhole intersected by oppositely spaced smaller semi-circular keyholes for interlocking rung pairs.

FIG. 9 is similar to the variation of FIG. 8 and shows placement of interlocking semi-circular keyholes 98, 98A on either side of the openings of center keyhole 100.

In the embodiments of FIGS. 7A, 8 and 9, the material for the bands should be chosen from heavier more sturdy woven plastics as they are intended for heavier utility ladders to compensate for the extra directional strains of rung pairs on each side of the band.

SUMMARY

The novel use of a combination of pivot post and Belleville washer provides a wide choice of chevron rung pair angles and configurations to avoid overtraining due to the sameness of drills.

A repair/replacement cost savings for a complete one-piece rung is gained by only having to replace one of the rung pairs herein disclosed.

Valuable indoor gym time and space are also gained by the athletes in footwork drills allowing side by side competition by the novel use of the double ended key hole embodiments herein disclosed.

What is claimed is:

1. An agility ladder comprising rung pairs having outer rung ends attached to spaced parallel side bands by releasable spring interlock clamps with each rung pair having two rungs with adjacent thin overlapping ends joined by a pivot post, the adjacent thin overlapping ends forming a straight-line rung pair changeable to a variable chevron prow by pivoting about an axis of the pivot post, each of the outer rung ends attached to the spaced parallel side bands having at least one row of entrance/exit keyholes through the outer rung ends, and the releasable spring interlock clamps each having upper and lower spring clamp arms clamping the spaced parallel side band anywhere along a length of the side band, the upper spring clamp arm carrying an upwardly positioned retainer pole with a retainer disc engaging through one of the entrance/exit keyholes to retain the outer rung end over the spaced parallel side band.

2. An agility ladder comprising rung pairs spaced between parallel bands with each rung pair having outer rung ends attached to the parallel bands by a releasable spring clamp having upper and lower clamp arms, each rung pair having two rungs with adjacent thin overlapping ends joined by a pivot post, the adjacent thin overlapping ends forming a rung pair having a straight line changeable to a variable chevron prow by pivoting about an axis of the pivot post, each of the outer rung ends having at least one row of entrance/exit keyholes through the outer rung ends engaged by a retainer pole and a retainer disc carried by the upper clamp arm of the releasable spring clamp.

* * * * *